United States Patent [19]

Ball et al.

[11] Patent Number: 4,481,083

[45] Date of Patent: Nov. 6, 1984

[54] PROCESS FOR ANODIZING ALUMINUM FOIL

[75] Inventors: John A. Ball, Grassy Creek, N.C.; John W. Scott, Clinton, Tenn.

[73] Assignee: Sprague Electric Company, North Adams, Mass.

[21] Appl. No.: 528,184

[22] Filed: Aug. 31, 1983

[51] Int. Cl.[3] ..... C25D 11/16; C25D 11/08

[52] U.S. Cl. ..... 204/38 A; 204/28; 204/29; 204/42; 204/58

[58] Field of Search ..... 204/29, 27–28, 204/35 N, 38 A, 58, 42

[56] References Cited

U.S. PATENT DOCUMENTS

| | | | |
|---|---|---|---|
| 1,012,889 | 1/1910 | Mershon | 204/58 |
| 2,122,392 | 6/1938 | Robinson et al. | 204/58 |
| 2,151,806 | 3/1939 | Schnoll et al. | 175/315 |
| 4,113,579 | 9/1978 | Randall et al. | 204/33 |

FOREIGN PATENT DOCUMENTS

| | | |
|---|---|---|
| 1564666 | 7/1970 | Fed. Rep. of Germany . |
| 1395070 | 5/1975 | United Kingdom . |
| 1451887 | 10/1976 | United Kingdom . |

*Primary Examiner*—R. L. Andrews

[57] ABSTRACT

In an integrated process for the anodization of aluminum foil for electrolytic capacitors including the formation of a hydrous oxide layer on the foil prior to anodization and stabilization of the foil in alkaline borax baths during anodization, the foil is electrochemically anodized in an aqueous solution of boric acid and 2 to 50 ppm phosphate having a pH of 4.0 to 6.0. The anodization is interrupted for stabilization by passing the foil through a bath containing the borax solution having a pH of 8.5 to 9.5 and a temperature above 80° C. and then reanodizing the foil. The process is useful in anodizing foil to a voltage of up to 760 V.

8 Claims, No Drawings

PROCESS FOR ANODIZING ALUMINUM FOIL

BACKGROUND OF THE INVENTION

This invention relates to an integrated process for the anodization of aluminum electrolytic capacitor foil. A hydrous layer is first formed on the foil, and then it is electrochemically anodized in a bath containing boric acid and 2 to 50 ppm phosphate at a pH of 4.0 to 6.0. Anodization is interrupted to stabilize the foil by passing it through a bath containing a mildly alkaline borax solution at a temperature above 80° C. Thereafter, the foil is reanodized in the boric acid electrolyte. Foil sutiable for use in electrolytic capacitors for up to 760 V service is produced by this process.

Improvements have been made both in the manufacture of aluminum foil for electrolytic capacitors and in the etching of such foil resulting in the capability of producing higher voltage foil than had been possible until recently. The improvements resulted in a need for anodization processes capable of producing higher voltage dielectric oxide films to take advantage of these newer foils and etching processes.

It has been customary to form a hydrous oxide layer on aluminum foil prior to anodization of the foil for service above about 200 V. Usually this hydrous oxide layer is formed by passing the foil into boiling deionized water. This layer permits anodization to above 200 V and permits power savings during anodization and a higher capacitance per given anodization voltages. Although the use of a hydrous oxide layer is not new, the mechanism by which it produces the above results is still not understood.

The prior art has shown the use of borate and citrate electrolyte for anodization up to 500 V, generally up to about 450 V. The anodization process which was capable of producing 500 V foil was an excessively lengthy and cumbersome process not suitable for present day manufacturing schemes. In particular, the stabilization or depolarization time required was excessively long.

This stabilization or depolarization is needed as it is well-documented that aluminum capacitor foil after apparently complete formation of a high voltage dielectric oxide film evidences instability as shown by a sudden loss of field strength. This behavior is most markedly observed when the foil also bears a hydrous oxide layer formed prior to anodization. There is general agreement in the electrolytic capacitor industry that this dielectric instability is caused by the creation of voids within the formed dielectric oxide layer. It has been further postulated that oxygen gas is trapped within these voids and is liberated during the stabilization or "depolarization" treatment that bring about a relaxation in the strength of the dielectric.

Whatever the actual physical mechanism which may be involved, it is known in the prior art to remedy the situation by various so-called depolarizing techniques—heating, immersion in hot water with and without various additives, mechanical flexing, pulsed currents, current reversal, or a combination of these—in short, methods which tend to relax or crack the dielectric barrier layer oxide so that these voids may be filled with additional dielectric oxide and thereby impart permanent stability to the oxide film.

One such process is described by Walter J. Bernard in a copending application filed on even date herewith. His process involves passing anodized foil through a bath containing preferably an aqueous borax solution having a pH of 8.5 to 9.5 at a temperature above 80° C. While boric acid or borax at acidic pH controls the hydration of aluminum foil, at the mildly alkaline pH above, borax is more effective than the hot water reaction in opening up the dielectric film. In addition to opening up this film, it seems to attack the excess hydrous oxide present without damaging the barrier layer dielectric oxide and leads to the formation of a stable dielectric oxide upon subsequent reanodization of the foil.

SUMMARY OF THE INVENTION

This invention features an integrated process for the anodization of aluminum electrolytic capacitor foil, particularly up to 760 V. It involves first forming a hydrous oxide layer on the foil by immersing the foil in boiling deionized water, and then subjecting the foil to electrochemical anodization in a bath containing an aqueous solution of boric acid and 2 to 50 ppm phosphate at a pH of 4.0 to 6.0 as electrolyte. The foil is then passed through a bath containing, preferably, a borax solution having a pH of 8.5 to 9.5 at a temperature of at least 80° C., and then reanodized in the boric acid-phosphate electrolyte. A stabilized foil suitable for up to 760 V use is produced.

The anodizing electrolyte contains 10–120 g/l of boric acid, 2 to 50 ppm phosphate, preferably as phosphoric acid, and sufficient alkaline reagent to lower the resistivity to within 1500–3600 ohm-cm and increase the pH to 4.0 to 6.0 for best anodization efficiency and foil quality.

The borax baths contain 0.001 to 0.05 moles/liter of borax. Because the anodizing electrolyte is acidic, the borax baths are buffered with sodium carbonate to prevent lowering of the pH by dragout of the acidic electrolyte on the foil and to lower the resistivity of the baths. The pH of the baths is 8.5 to 9.5. The sodium concentration is 0.005to 0.05M, preferably 0.02 M. Concentrations of less than 0.005M are too dilute to control properly, and concentrations above 0.05M start increasing the pH, leading to a more reactive solution which degrades barrier layer oxide quality.

The presence of at least 2 ppm phosphate in the acidic anodizing electrolyte is critical. It initiates stabilization of the foil so that only hydrous oxide is dissolved in the alkaline borax baths without damaging the barrier layer dielectric oxide. When the foil is reanodized following the alkaline borax baths, the foil surface is alkaline (presumably a sodium aluminate surface) and reacts electrochemically with the phosphate being incorporated into the dielectric oxide.

It has been found that this reaction is an electrochemical one; soaking the foil in a phosphate medium does not give the same results. The amount of allowable phosphate in the anodizing electrolyte was found also to be inversely proportional to the voltage to which the foil is being anodized, e.g., 24 ppm maximum for 650 V foil. The upper limit is 50 ppm phosphate as, if the limit is exceeded, the electrolyte scintillates at the foil interface and damaged, unstable foil is produced. Heretofore, phosphate-containing electrolytes have only been capable of use through 450 V or in the final anodization at 80% of the final voltage. Control of the phosphate within 2 to 50 ppm permits usage through the anodization process without scintillation up to above 700 V. Anodization temperature is maintained between 85° C. and 95° C. Below 85° C., the barrier layer oxide quality decreases and the aluminum appears to start corroding. Above 95° C., the heat of formation is great enough so there is steam generated and the anodization electrolyte boils over creating hazardous conditions.

DESCRIPTION OF THE PREFERRED EMBODIMENTS

The integrated process of the present invention is suitable for the production of anodized aluminum electrolytic capacitor foil for 200–760 V service. After formation of hydrous oxide by known means, the invention features the use of 2–50 ppm phosphate in a boric acid anodization electrolyte coupled with the borax stabilization or depolarization process at pH 8.5 to 9.5 followed by reanodization. The alkaline borax bath dissolves excess hydrous oxide, effectively cleaning out the etch tunnels or pores which lowers ESR (equivalent series resistance) of the anodized foil, and gives a reactive foil surface leading to the incorporation of phosphate into the barrier layer dielectric oxide film in the reanodization step.

The following example shows the usefulness of foil produced by the process of the present invention. The anodizing solution contained 15 ppm phosphate for 652 V anodization and its resistivity was 2500 Ω-cm at 90° C. The borax bath contained 0.02 moles/liter borax and 0.019 moles/liter sodium carbonate.

EXAMPLE 1

Foil anodized as above was used in 3-inch, 450 V capacitors. Both life and shelf tests were carried out at 85° C. Average results are given for initial, 250 hrs., and 500 and 1000 hrs. DC Leakage current (DCL) is measured in microamps, capacitance in microfarads and ESR in milliohms, and changes in these in percent.

TABLE 1

| | Time | Cap | ΔC | ESR | ΔESR | DCL | ΔDCL |
|---|---|---|---|---|---|---|---|
| Life | 0 | 2142 | — | 0.030 | — | 0.433 | — |
| | 250 | 2099 | −2.0 | 0.031 | +3.3 | 0.248 | −74.6 |
| | 500 | 2091 | −2.4 | 0.029 | −3.4 | 0.234 | −85 |
| | 1000 | 2110 | −1.5 | 0.028 | −7.1 | 0.185 | −134 |

TABLE 1-continued

| | Time | Cap | ΔC | ESR | ΔESR | DCL | ΔDCL |
|---|---|---|---|---|---|---|---|
| Shelf | 0 | 2132 | — | 0.030 | — | 0.455 | — |
| | 250 | 2080 | −2.5 | 0.027 | −11.1 | 0.945 | +108 |
| | 500 | 2080 | −2.5 | 0.023 | −30.0 | 0.952 | +109 |
| | 1000 | 2079 | −2.5 | 0.021 | −42.8 | 1.125 | +147 |

Thus, it can be seen that the present integrated process yields a stable, high voltage foil well within accepted range.

What is claimed is:

1. In an improved process for the anodization of aluminum foil for electrolytic capacitors including first forming a hydrous oxide layer on said foil prior to anodization of said foil, and repeatedly interrupting said anodization to stabilize said foil in a mildly alkaline bath, the improvement comprising conducting said anodization in a bath containing an aqueous solution of 10 to 120 g/l boric acid and 2 to 50 ppm phosphate as electrolyte at a pH of 4.0 to 6.0 and a temperature of 85° to 95° C., whereby said foil can be anodized to 760 V without scintillation.

2. A process according to claim 1 wherein the resistivity of said electrolyte is 1500–3600 ohm-cm.

3. A process according to claim 1 wherein said pH of said boric acid solution is attained by the addition of a reagent selected from the group consisting of ammonium and alkali metal hydroxides and ammonium and alkali metal salts.

4. A process according to claim 3 wherein said reagent is selected from the group conisisting of sodium hydroxide and borax.

5. A process according to claim 1 wherein said phosphate is phosphoric acid.

6. A process according to claim 1 wherein said stabilizing is carried out by passing said foil through a bath containing a 0.001 to 0.05M borax solution having a pH of 8.5 to 9.5 and a temperature of at least 80° C.

7. A process according to claim 6 wherein said borax solution is buffered by 0.005 to 0.05M sodium carbonate solution.

8. A process according to claim 7 wherein there are at least two stabilizing treatments.

* * * * *

UNITED STATES PATENT AND TRADEMARK OFFICE

CERTIFICATE OF CORRECTION

PATENT NO. : 4,481,083

DATED : November 6, 1984

INVENTOR(S) : John A. Ball et al

It is certified that error appears in the above—identified patent and that said Letters Patent is hereby corrected as shown below:

Column 1, line 14, "sutiable" should read -- suitable --

Column 1, line 66, after "herewith" insert -- , now US 4,437,946, issued March 20, 1984 --

Signed and Sealed this

*Twenty-sixth* Day of *March 1985*

[SEAL]

*Attest:*

DONALD J. QUIGG

*Attesting Officer*

*Acting Commissioner of Patents and Trademarks*